United States Patent [19]

Hubbard

[11] 4,397,213

[45] Aug. 9, 1983

[54] HARMONICA HOLDER AND SHROUD

[76] Inventor: Dana L. Hubbard, 21060 E. Fifth St., Sonoma, Calif. 95476

[21] Appl. No.: 398,985

[22] Filed: Jul. 16, 1982

[51] Int. Cl.[3] ..... G10G 5/00

[52] U.S. Cl. ..... 84/453; 84/379; 84/DIG. 14

[58] Field of Search ..... 84/377–379, 84/DIG. 14, 453

[56] References Cited

U.S. PATENT DOCUMENTS

| | | | |
|---|---|---|---|
| 2,565,100 | 8/1951 | Tate | 84/377 |
| 2,664,775 | 1/1954 | Zielinski | 84/377 |
| 2,772,593 | 12/1956 | Zielinski | 84/DIG. 14 |
| 2,945,408 | 7/1960 | Terlinde | 84/378 |
| 3,593,145 | 7/1971 | Valley | 84/453 |
| 4,091,704 | 5/1978 | Moe | 84/378 |
| 4,212,219 | 7/1980 | Hubbard | 84/379 |

*Primary Examiner*—Lawrence R. Franklin
*Attorney, Agent, or Firm*—Melvin R. Stidman

[57] ABSTRACT

A harmonica holder and shroud comprising a base plate and a parallel movable, spring-biased bar, together forming a clamp to grip a harmonica between them in position directly in front of a microphone, as determined by an insulated backstop. A leather shroud is folded over each bar and extends rearward therefrom over and under the microphone so that both harmonica and microphone are enclosed or shrouded together. A sleeve clamp secures the ends of the shrouds, as well as a rearwardly extending support for the base plate, to the microphone to hold the harmonica and shrouds in place.

5 Claims, 2 Drawing Figures

HARMONICA HOLDER AND SHROUD

BACKGROUND OF THE INVENTION

This is an improvement over the invention shown in my previous U.S. Pat. No. 4,212,219, which was granted July 15, 1980 for "Harmonica Stand". In that invention, means were provided for supporting a harmonica next to a microphone so that the musician had his hands free to play a guitar, piano or the like in accompaniment with the harmonica rendition. Means were also provided to shield the microphone from sound distortions which might result from blowing into it.

OBJECTS OF THE INVENTION

It is an object of this invention to provide a shroud for a harmonica which cups the harmonica and microphone for deeper, warmer tones.

It is a further object of this invention to provide a shroud which clamps a harmonica in place on a microphone to emit sounds directly into a microphone while shielding the microphone from blowing or ambient noises directed around the harmonica.

It is a further object of this invention to provide a device for clamping a harmonica directly to a microphone, and shielding it from extraneous voices.

Other objects and advantages of this invention will become apparent from the description to follow, particularly when read in conjunction with the accompanying drawings.

SUMMARY OF THE INVENTION

In carrying out this invention, I provide a T-shaped support member, of which the stem may be secured to the microphone handle by means of an adjustable clamping sleeve. The cross-member of the "T" is a base plate for mounting the harmonica, and is directed generally horizontally in front of the microphone. The base plate carries a parallel clamping bar which is spring-biased toward the base plate to clamp a harmonica against the base plate in proper playing position as determined by an insulated backstop bar. Top and bottom wraps or shrouds of leather or the like, which are shaped like isosceles triangles have their bases folded around and secured to the pressure bar and base plate, respectively. A microphone is received between the top and bottom shroud sections to be disposed directly behind the harmonica, and the trailing ends of the shroud are gripped by the clamping sleeve which binds them tightly around the shaft or handle of the microphone as it grips the stem of the T-support bracket.

DESCRIPTION OF A PREFERRED EMBODIMENT

Figure 1:
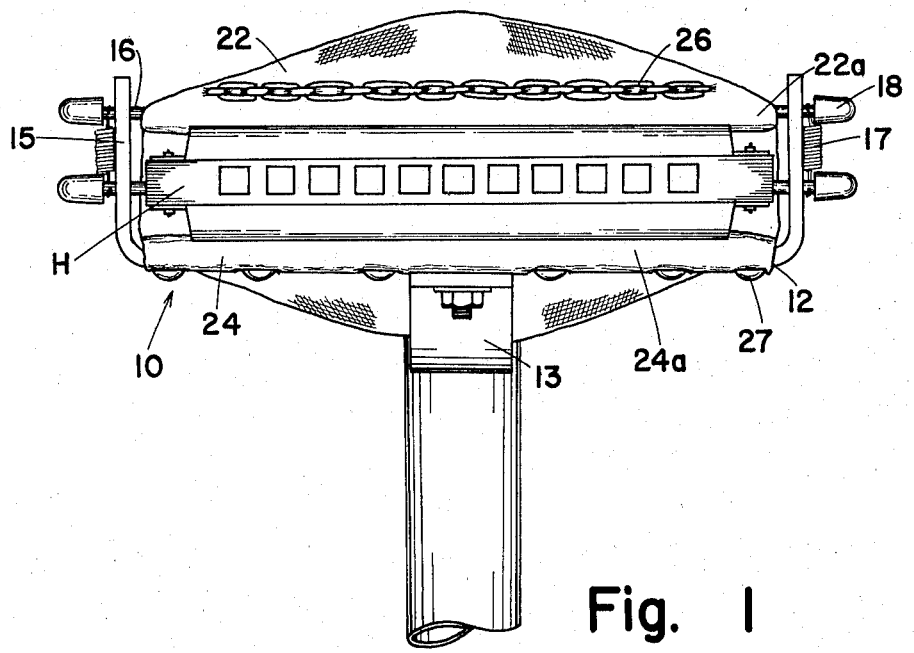
FIG. 1 is a front elevation of the harmonica holder of this invention.

Referring now to the drawings with greater particularity, the harmonica holder and shroud 10 of this invention comprises a base plate 12 which may be formed as the cross-member of a T-shaped bracket with the stem of the "T" 13 extending rearward as shown. Slidably carried in slots 14 in upstanding arms 15 at the ends of the base plate 12 is a pressure bar or rod 16 which is spring-biased by springs 17 toward the base plate 12 so as to clamp a harmonica H firmly against the base plate 12. The knobs 18 at the ends of the pressure rod 16 may be grasped to lift the pressure rod 16 and insert the harmonica H. Then, the knob 18 is simply released to clamp the harmonica H in place.

Figure 2:
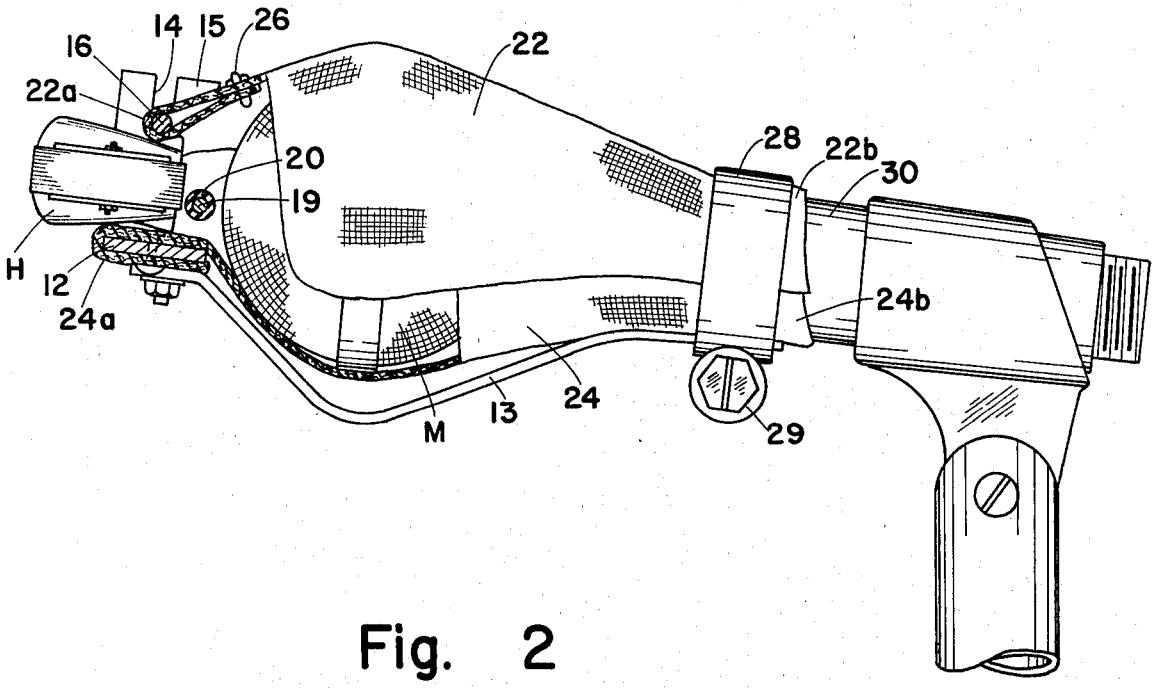
FIG. 2 is a side view of the harmonica holder partially broken away.

Another rod 19 (FIG. 2) which is covered with an insulating material such as rubber 20 extends between the upstanding arms 15 of the base plate to provide a location stop for the insertion of the harmonica H positioning it immediately in front of the microphone M, preventing any electrical contact between the harmonica H and the microphone M.

Secured to and wrapped around the pressure bar 16 and base plate 12, respectively, are top and bottom acoustical shrouds or wraps 22 and 24 of a relatively heavy, sound isolating, electrical insulating material, such as leather. The top and bottom shrouds are formed generally as truncated isosceles triangles, and the base **22*a* of the top shroud 22 is wrapped around the pressure bar 16 and stitched or laced thereto at 26 to extend rearward therefrom. The base end 24*a* of the bottom shroud 24 may simply be wrapped around and secured to the base plate 12, as by means of rivets 27. The top and bottom wraps may be separated to receive a microphone M therebetween and then an adjustable sleeve clamp 28 may be tightened at 29 to secure the trailing ends 22*b* and 24*b* around the handle or support 30 of the microphone M. Both the T-support 13 and the clamping sleeve 28 are insulated from the microphone by the top and bottom wraps 22 and 24**.

While this invention has been described in conjunction with a preferred embodiment thereof, it is obvious that modifications and changes therein may be made by those skilled in the art to which it pertains without departing from the spirit and scope of this invention, as defined by the claims appended hereto.

What I claim as invention is:

1. A harmonica support comprising:

a generally horizontal base plate;

a generally horizontal pressure bar carried above said base plate for movement toward and away from said base plate;

spring means biasing said pressure bar toward said base plate to clamp a harmonica therebetween;

a top wrap and a bottom wrap of a relatively heavy sheet material shaped generally as isosceles triangles with the bases thereof folded over and secured to said pressure bar and said base plate, respectively;

a microphone being receivable between said top and bottom wraps; and an adjustable clamping sleeve receivable over the trailing relatively narrow ends of said top and bottom wraps and the handle of a microphone received therebetween.

2. The harmonica support defined by claim 1 including:

a rib support secured to said base plate to extend rearward therefrom beneath said bottom wrap to be received by said clamping sleeve.

3. The harmonica support defined by claim 1 including:

a backstop secured above said base plate to limit insertion of a harmonica therebetween.

4. The harmonica support defined by claim 1 wherein:

said heavy sheet material is relatively sound isolating and electrically insulated.

5. The harmonica support defined by claim 1 wherein said heavy sheet material is leather.

* * * * *